United States Patent [19]

Salomon

[11] 4,139,211

[45] Feb. 13, 1979

[54] SAFETY BINDING FOR SKI BOOT

[75] Inventor: Georges P. J. Salomon, Annecy, France

[73] Assignee: Establissements Francois Salomon et Fils, Annecy, France

[21] Appl. No.: 795,758

[22] Filed: May 11, 1977

[30] Foreign Application Priority Data

May 14, 1976 [FR] France ..... 76 14710

[51] Int. Cl.[2] ..... A63C 9/08

[52] U.S. Cl. ..... 280/618; 280/613

[58] Field of Search ..... 280/613, 614, 616, 617, 280/618, 620, 636

[56] References Cited

U.S. PATENT DOCUMENTS

| | | | |
|---|---|---|---|
| 3,944,237 | 3/1976 | Teague | 280/618 |
| 4,027,896 | 6/1977 | Frechin | 280/613 X |
| 4,033,603 | 7/1977 | Horn | 280/618 |
| 4,036,510 | 7/1977 | D'Alessio | 280/618 X |

*Primary Examiner*—Joseph F. Peters, Jr.
*Assistant Examiner*—Gene A. Church
*Attorney, Agent, or Firm*—Pollock, Vande Sande & Priddy

[57] ABSTRACT

A safety binding for a ski boot comprising coupling means extending under the boot, and associated therewith, for coupling the boot to retention means mounted upon the ski; the retention means are hinged about a pivot integral with the ski. Safety-releasable locking means make it possible to lock the coupling means in relation to the ski, when the ski is fitted to the boot. A design of this kind makes it easy to fit the ski under any circumstances and eliminates the fumbling due to the fact that the pivot cannot be seen by the skier.

15 Claims, 8 Drawing Figures

SAFETY BINDING FOR SKI BOOT

The present invention relates to a safety binding for a ski, more particularly to a binding in which coupling means extending under the boot are associated with the boot for the purpose of coupling it to retention means mounted upon the ski.

Ski bindings are known in which the coupling means are integral with a plate fitted under the sole of the boot, as in applicant's French Patent No. 2,134,819, for example. This plate, which is integral with the boot, executes a safety release, in relation to the ski, when the skier falls, the release being achieved against the action of a resilient system.

Certain designers have proposed arrangements comprising a vertical pivot, integral with the ski, about which the plate may pivot. In the designs disclosed in French Patent No. 2,218,114 (CARPANO) and Austrian Patent Application No. 6182/74 (SMOLKA), the pivot is located under the sole of the boot. Since the skier cannot see the pivot, he can refit his ski only tentatively, which is particularly inconvenient when done on a steep slope. It should also be noted that snow may accumulate in the housing in the plate designed to receive the pivot. This adds to the difficulty and may result in the skier fitting the ski incorrectly, or being unable to fit it at all.

It is an object of the present invention to overcome these problems, or, in other words, to provide a safety binding which has the advantages of known pivot bindings, i.e., a binding which does not offer unwanted resistance to release in the event of a lateral fall and which makes it easy to fit the ski under all circumstances. To this end, the safety binding according to the present invention comprises: a vertical pivot integral with the ski and arranged, when the ski is fitted to the boot, under the sole of the boot; retention means hinged in relation to the pivot; means, associated with the boot, for coupling the retention means to the boot, when the ski is fitted to the boot, the coupling means extending at least partly under the sole of the boot; means which actuate the coupling means for locking the coupling means, when the ski is fitted to the boot, in relation to the retention means, and for locking the boot (associated with the coupling means) in relation to the ski, in a manner permitting safety release.

This combination of means makes it possible to achieve the purpose of the present invention and, since a central pivot is provided under the boot, as in known pivoting bindings, the advantages of this design are available. Furthermore, since the retention means are mounted permanently to rotate about the pivot secured to the ski, there is no longer any need for fumbling, the ski being fitted by a simple coupling operation (actually an engagement) between the coupling means and the retention means; and, since the retention means may be located towards the front of the foot, they are at all times visible. This makes it easy to fit the ski.

According to another characteristic, which also facilitates the fitting of the ski, the pivot is preferably arranged between the locking means and the retention means (to be more precise, between the locking means and the area of cooperation between the retention means and the coupling means). According to one embodiment, the coupling means are integral with the sole of the boot. It is also conceivable, however, to arrange the coupling means upon a plate fitted detachably under the sole of the boot. This design allows the safety binding according to the invention to be adapted to a very wide range of boots.

According to still another characteristic of the invention, the coupling means preferably comprise engagement means arranged laterally and designed to cooperate with complementary shapes located upon the retention means. This lateral arrangement of the engagement elements contributes very essentially to facilitating the refitting of the binding, since the skier can see the elements without leaning over.

In certain embodiments in particular, the coupling means comprise laterally arranged ramps cooperating with other ramps of complementary shapes arranged laterally upon the retention means. This again makes it easier to fit the ski. The ramps preferably comprise sliding surfaces arranged symmetrically in relation to the longitudinal plane of symmetry of the ski; moreover, the sliding surfaces are arranged to extend (when the ski is fitted to the boot) in concurrent planes along a straight line running at an angle to the ski and located in the longitudinal plane of symmetry thereof. Other forms of cooperation between the coupling means and the retention means may be adopted. For instance, the coupling means could be in the form of a loop for engagement with the corresponding coupling means located at the front of the boot, or in the form of a hook located forward along the axis of the ski.

According to still another characteristic of the invention, the locking means preferably comprises a mobile locking ramp actuated by a resilient system. The ramp and system may be mounted either upon the ski, upon the fitted plate, or upon the sole of the boot.

Finally, the retention means may be mounted to rotate freely about the pivot, or they may be actuated by resilient means designed to restore them to a position of equilibrium after a release.

A description will now be given, by way of example and without implying any restriction, of several embodiments of the invention, with reference to the drawings attached hereto, wherein.

Figure 1:
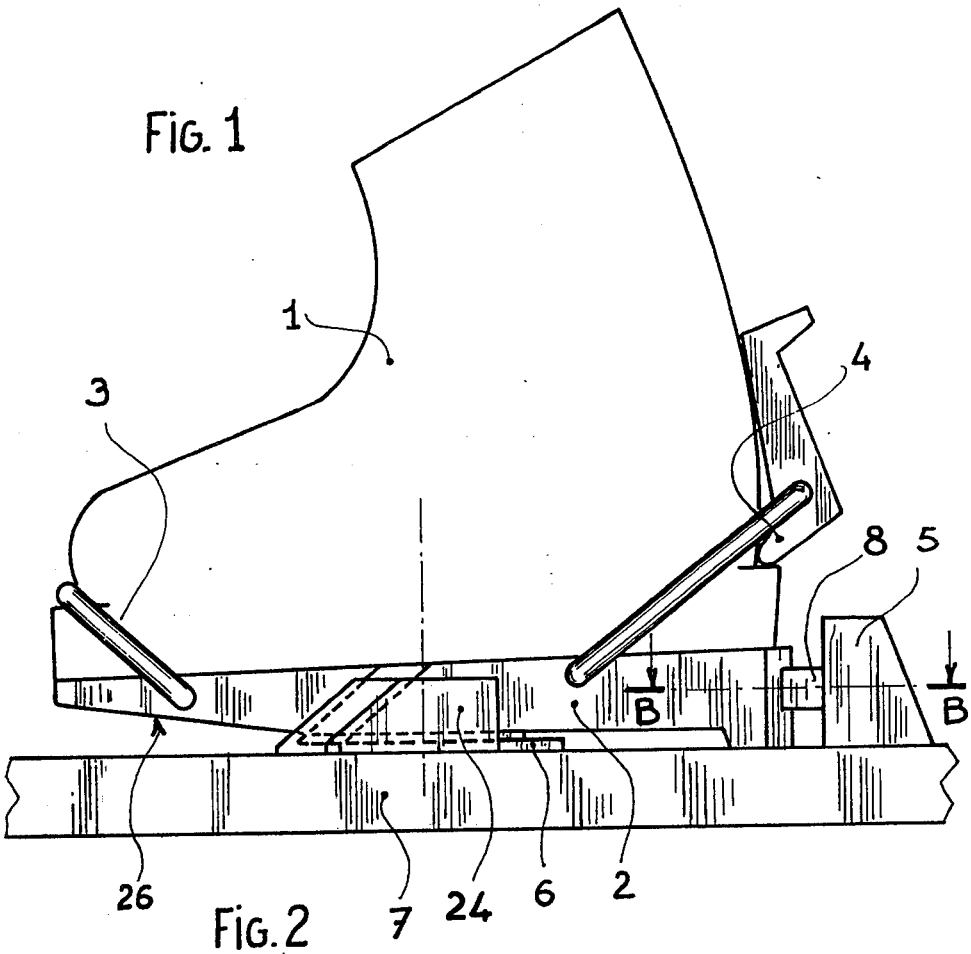
FIG. 1 is a side elevation of a first embodiment in which the coupling means are integral with a detachable plate.
Figure 2:
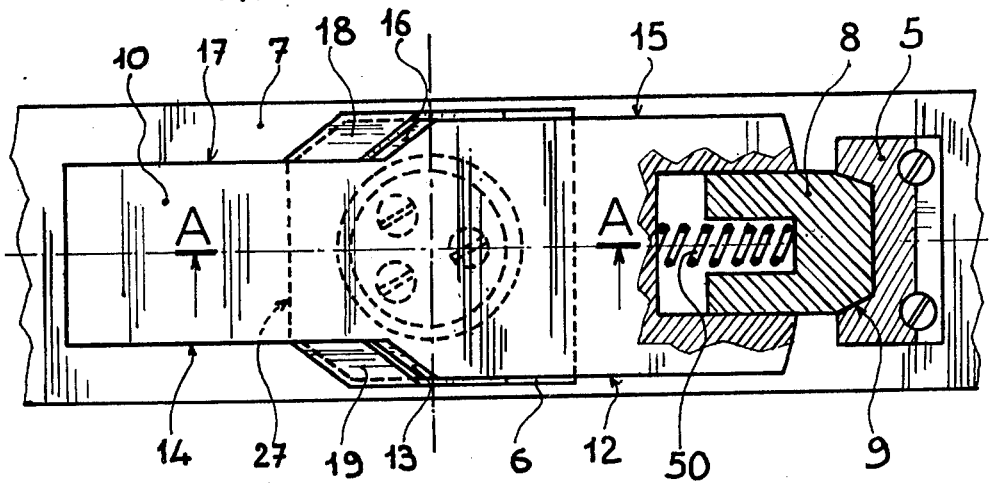
FIG. 2 is a plan view, in part section along line BB of the design illustrated in FIG. 1, the boot and the elements holding the boot to the plate being omitted.
Figure 3:
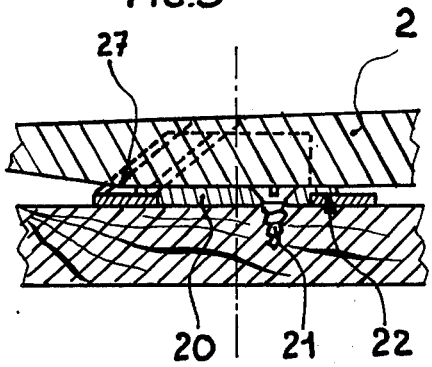
FIG. 3 is a section along line AA in FIG. 2, showing the retention means mounted pivotably upon the ski.
Figure 4:
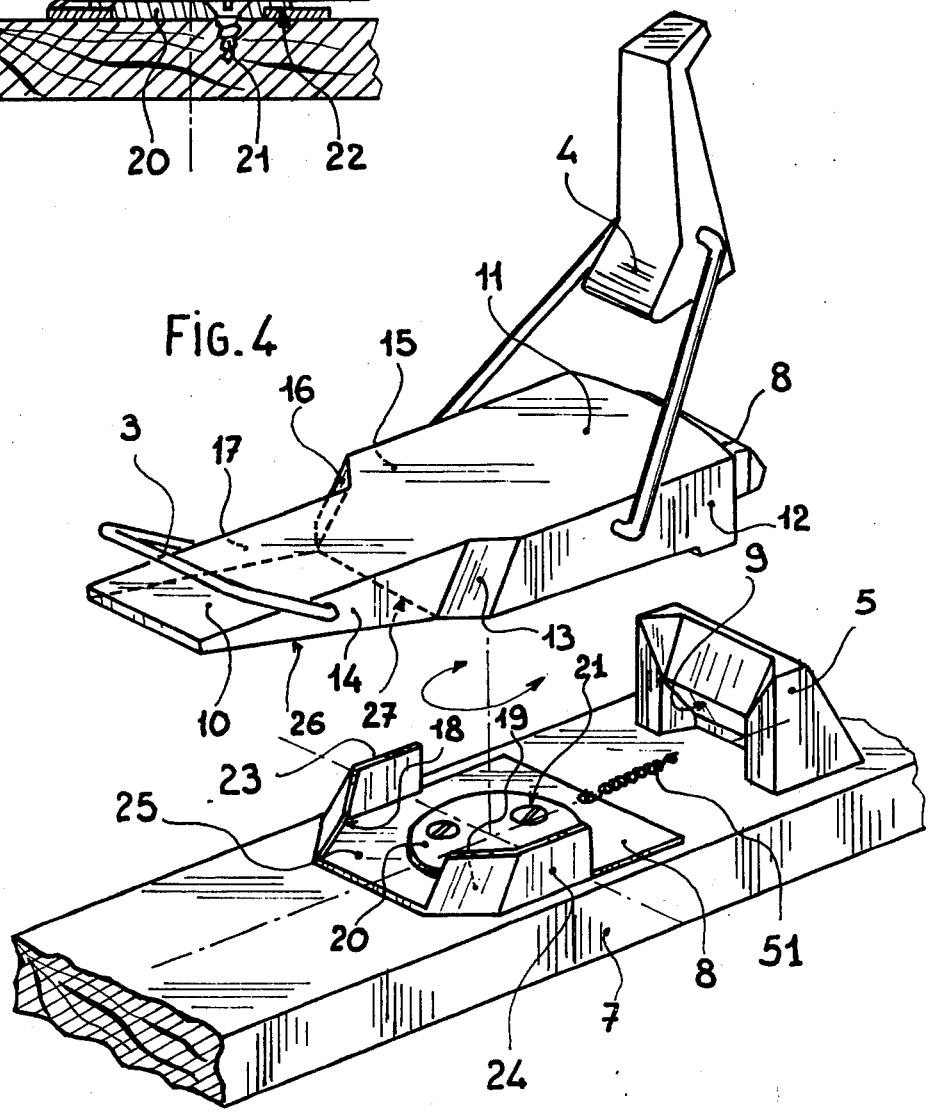
FIG. 4 is a perspective view of the first embodiment, the plate being released and the boot omitted.

According to the first embodiment illustrated in FIGS. 1, 2, 3 and 4, boot 1 is secured to a plate 2 by a front retaining element 3 and a rear retaining element 4. These two elements, being well known per se, will not be described in detail. Plate 2, which is fitted detachably under the boot, is releasable from the ski, to allow the skier's foot to be released in the event of a fall. To this end, plate 2 is held by retention means 6 adapted to pivot upon ski 7 and locked by locking means. Retention means 6 are preferably located in the area under the front of the foot. The locking means comprise a stop 5 which is integral with the ski, has a housing 9, and has a locking ramp 8 adapted to slide in rear part 11 of the plate. Locking ramp 8, which is spring loaded by an element 50, cooperates with housing 9 to lock the plate to the ski (in other words, to lock the boot to the ski). Conversely, the locking ramp and resilient means 50 may be mounted upon the stop, secured to the ski, in which the cooperating housing is located upon the plate.

Plate 2 has a rear part 11 of substantially the same width as the ski, and a narrower part 10 located under the front of the foot. The coupling means integral with plate 2 consist of edges 12, 14, 15, 17 arranged laterally, and ramps in the form of sliding surfaces 13, 16 which are arranged symmetrically, which slope rearwardly, and which run in concurrent planes in the longitudinal plane of symmetry of the ski, along a straight line at an angle to the surface of the ski.

It is desirable for the lower portion of part 10 of plate 2 to have an inclined plane 26, terminating at an edge 27 so that, in the event of a forward fall, plate 2 is released by rotation of the area of edge 27 located under the sole of the boot.

During the coupling operation, sliding surfaces 13, 16 engage in complementary lateral shapes 18, 19, respectively, of retention means 6.

The retention means, in the form of a metal plate, are mounted to rotate upon the ski about a vertical pivot 20 secured to ski 7 (for example by screws 21), the pivot having a circular shoulder 22 holding retention means 6 vertically. The axis of pivot 20 is located between locking means 5, 8, 9 and the area of cooperation between retention means 18, 19 and coupling means 13, 16. Retention means 18, 19 are bent parts of the metal plate; two other bent parts 23, 24, forming ramps, run laterally towards the rear. These parts provide guidance and lateral retention by cooperating with edges 12 and 15 of plate 2. Arranged in front of retention means 6 is a clearance 25 for the passage of the front part of plate 2.

A brief description will now be given of the way in which this embodiment operates. Lateral release, in the event of a fall, is achieved by plate 2 and retention means 6 rotating about pivot 20, against the action of the resilient means. When locking ramp 8 leaves housing 9 in stop 5, plate 2 also leaves retention means 6. In the event of a forward fall, plate 2 rotates about axis 27. Locking ramp 8 then releases the rear by leaving housing 9 in stop 5. In the event of a lateral fall, the assembly rotates about the axis of pivot 20, and ramp 8 is unlocked. In the event of a backward fall, surfaces 13, 16 of plate 2 slide in relation to corresponding surfaces 18, 19 of retention means 6. There is thus vertical sliding at the level of the engagement, and then release. All combinations of falling and release are permissible. The ski is refitted merely by engaging front part 10 of plate 2, defined by parallel lateral edges 14 and 17, in clearance 25, until surface 13 abuts surface 19 and surface 16 abuts surface 18; all that remains to be done is to fit the rear by engaging locking ramp 8 in housing 9 by vertical pressure of the heel. Weak resilient means 51 are provided solely for the purpose of restoring retention means 6 to the axial position after a release.

Figure 5:
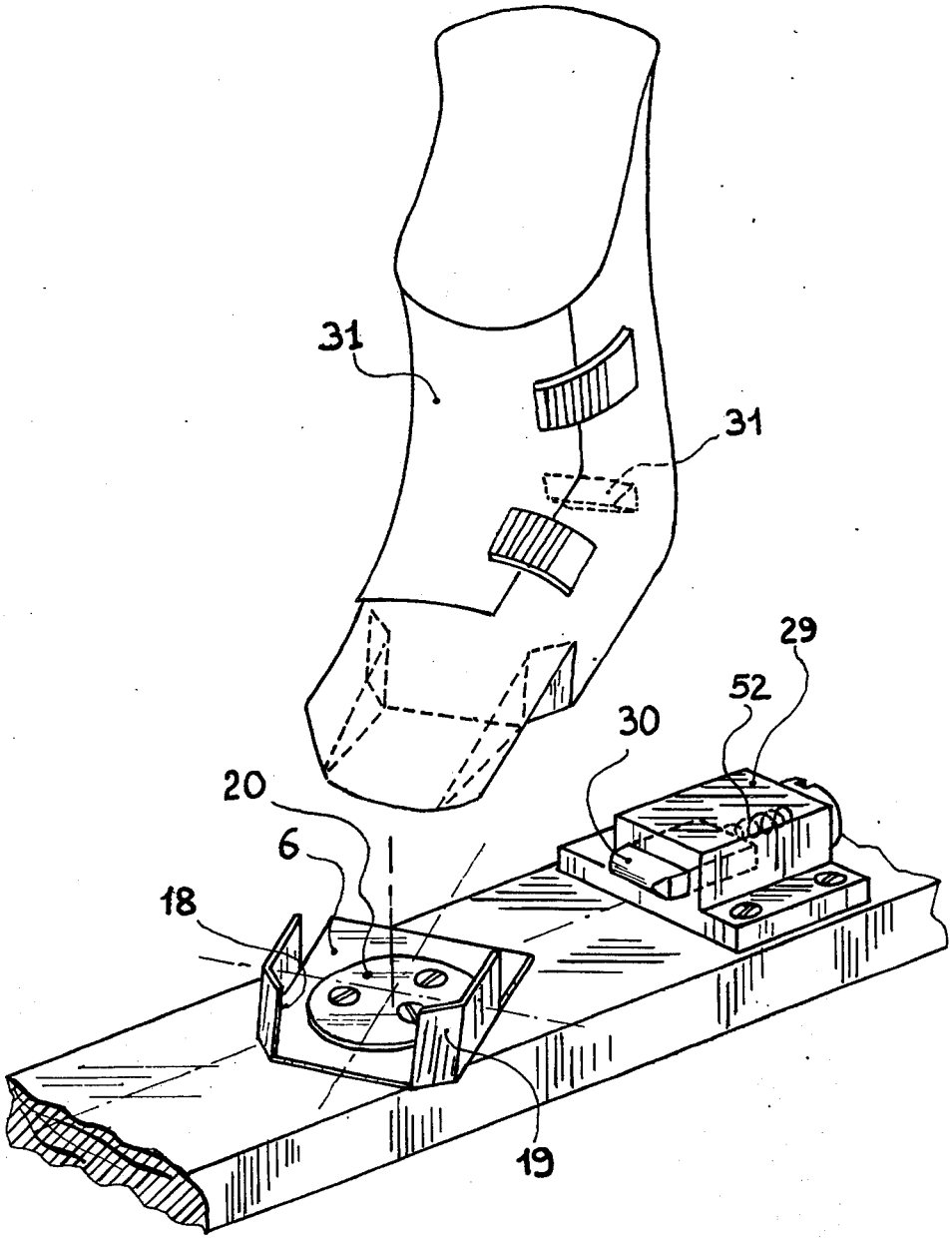
FIG. 5 is a perspective view of a second embodiment in which the coupling means are integral with the boot.

FIG. 5 illustrates a second embodiment, in which the coupling means are integral with the actual sole of the boot. As regards the coupling means, this sole is identical in shape with plate 2 of the preceding embodiment and it will therefore not be described here in detail. In the present embodiment, resilient system 52 is integral with stop 29 secured to the ski, locking ramp 30 cooperating with housing 31, of complementary shape, located behind the boot.

This figure shows retention means 6 mounted on the ski to rotate about pivot 20 described hereinbefore. In FIG. 5, the retention means are shown in the released position. This embodiment operates in exactly the same way as the preceding embodiment.

Figure 6:
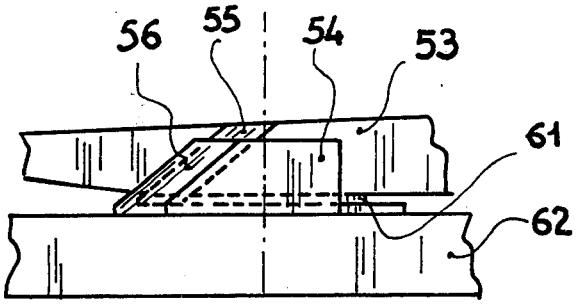
FIGS. 6, 7, 8 are diagrams illustrating possible forms of cooperation between the coupling means and the retention means.
Figure 7:
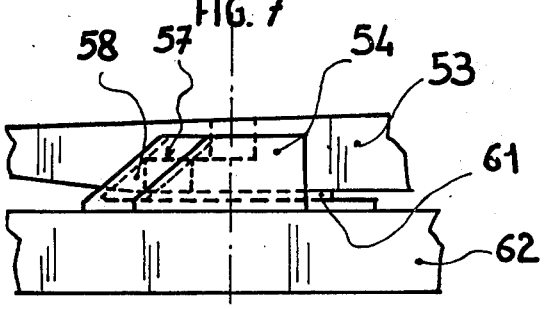
Figure 8:
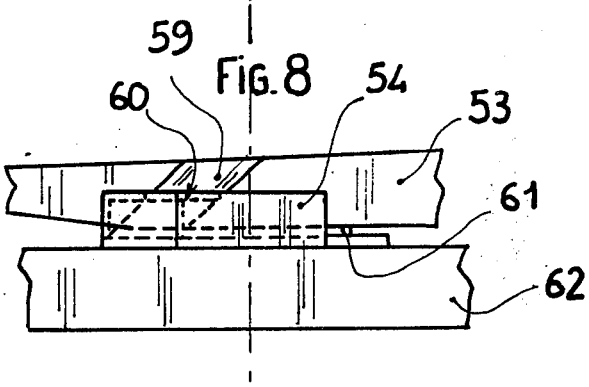

FIGS. 6, 7, 8 illustrate diagrammatically possible forms of cooperation between coupling means 53 and retention means 54; pivot 61 is secured to ski 62.

According to FIG. 6, cooperation between means 53 and 54 is through substantially parallel sloping surfaces 55 and 56. The embodiments described above are based upon this diagram.

According to FIG. 7, the cooperation takes place between sloping surfaces 58 of retention means 54 and an engagement element consisting of an edge 57 arranged upon coupling means 53.

According to FIG. 8, the cooperation takes place between sloping surfaces 59 on coupling means 53 and an engagement element consisting of an edge 60 arranged upon retention means 54.

In the case of the two embodiments described above in detail, the coupling means integral with the detachable plate (or with the sole) have been placed with advantage laterally on each side, in order to eliminate problems arising from packing with snow and, furthermore, to provide satisfactory lateral retention of the foot by the boot; however, designs in which the coupling means are located centrally along the axis of the ski are also covered by the invention. Moreover, although in the designs described above the locking means are located at the rear, the arrangement may be reversed, with the locking means located at the front and the retention means at the rear.

What is claimed is:

1. A safety binding for coupling a ski boot to a ski, comprising
   (a) a vertical pivot integral with said ski and disposed, upon fitting of the ski to said boot, under the sole of said boot;
   (b) retention means hinged in relation to said pivot;
   (c) means associated with said boot for coupling said retention means to said boot, when said ski is fitted to said boot, and for completely freeing said retention means from said boot in safety release position, said coupling means extending at least partly under said boot; and
   (e) locking means, actuating said coupling means, for locking said coupling means with respect to said retention means upon fitting said ski to said boot, and for locking said boot with respect to said ski, in a manner permitting safety release.

2. A binding according to claim 1, wherein said pivot is arranged between said locking means and said retention means.

3. A binding according to claim 1, wherein said coupling means are integral with the sole of the boot.

4. A binding according to claim 1, wherein said coupling means are integral with a plate fitted detachably under the sole of the boot.

5. A binding according to claim 1, wherein said locking means comprise at least one mobile locking ramp actuated by a resilient system.

6. A binding according to claim 5, wherein said mobile locking ramp and said resilient system are mounted upon the ski.

7. A binding according to claim 5, wherein said mobile locking ramp and said resilient system are mounted upon the fitted plate.

8. A binding according to claim 5, wherein said coupling means are integral with the sole of the boot; said mobile locking ramp and the resilient system being mounted upon the sole of the boot.

9. A binding according to claim 1, wherein the axis of said pivot is located under the front part of the boot.

10. A binding according to claim 1, wherein said retention means pivot freely about said pivot.

11. A binding according to claim 1, wherein said retention means are actuated by resilient means designed to restore them to a position of equilibrium.

12. A binding according to claim 1, wherein said coupling means comprise first ramps arranged laterally; said retention means comprising second ramps, the shapes of which are complementary to those of the first laterally arranged ramps, so that the skier may conveniently refit his skis without fumbling.

13. A binding according to claim 12, wherein said first and second ramps comprise sliding surfaces arranged symmetrically in relation to the plane of symmetry of the ski, said surfaces running, when the ski is fitted to the boot, in planes coinciding with a straight line located in the plane of longitudinal symmetry of the ski and at an angle to the ski.

14. A binding according to claim 1, wherein said coupling means comprise means of engagement designed to cooperate with complementary elements located upon said retention means, said engagement means being arranged laterally, so that the skier may conveniently refit his skis without fumbling.

15. A ski boot safety binding comprising (a) a vertical pivot integral with a ski and disposed, upon fitting of said ski to a ski boot, under the sole of said boot;

(b) retention means hinged in relation to said pivot;

(c) coupling means associated with said boot for coupling said retention means to said boot upon fitting said ski to said boot, said coupling means extending under said boot;

(d) locking means associated with said boot for locking said coupling means with respect to said ski and assuring at least vertical and lateral safety retention of said coupling means associated with said boot;

(e) said pivot being arranged between said locking means and the area of cooperation between said retention means and said coupling means.

* * * * *